US012098480B2

(12) United States Patent
Sommer et al.

(10) Patent No.: US 12,098,480 B2
(45) Date of Patent: Sep. 24, 2024

(54) METHODS OF MAKING A NONWOVEN FROM CONTINUOUS FILAMENTS

(71) Applicant: The Procter & Gamble Company, Cincinnati, OH (US)

(72) Inventors: Sebastian Sommer, Troisdorf (DE); Tobias Wagner, Cologne (DE); Gerold Linke, Hennef (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/299,909

(22) Filed: Apr. 13, 2023

(65) Prior Publication Data

US 2023/0250558 A1 Aug. 10, 2023

Related U.S. Application Data

(63) Continuation of application No. 17/213,873, filed on Mar. 26, 2021, now Pat. No. 11,655,563, which is a (Continued)

(30) Foreign Application Priority Data

Apr. 29, 2016 (EP) ..... 16167804

(51) Int. Cl.
*D01D 5/088* (2006.01)
*D01D 5/098* (2006.01)

(Continued)

(52) U.S. Cl.
CPC ..... *D01D 5/088* (2013.01); *D01D 5/0985* (2013.01); *D01D 10/00* (2013.01); *D04H 3/005* (2013.01);

(Continued)

(58) Field of Classification Search
CPC ..... D01D 5/088; D01D 5/0985; D01D 10/00; D04H 3/005; D04H 3/02; D04H 3/14; D04H 3/16; D04H 3/163
See application file for complete search history.

(56) References Cited

U.S. PATENT DOCUMENTS 4,333,979 A 6/1982 Sciaraffa
4,514,345 A 4/1985 Johnson et al.

(Continued)

FOREIGN PATENT DOCUMENTS

CN 1209177 A 2/1999
CN 1441102 A 9/2003

(Continued)

OTHER PUBLICATIONS

All Office Actions; U.S. Appl. No. 17/529,345, filed Nov. 18, 2021.

(Continued)

*Primary Examiner* — Susan D Leong
*Assistant Examiner* — Joseph S Leyson
(74) *Attorney, Agent, or Firm* — Christian M. Best

(57) ABSTRACT

A method of making a nonwoven from continuous filaments is provided. The method comprises the steps of spinning continuous filaments from a spinneret to move along a vertical travel path in a vertical travel direction, cooling and stretching the filaments downstream of the spinneret in a cooler and a stretcher, and depositing the cooled and stretched filaments at a deposition location on a foraminous belt moving horizontally underneath the cooler and stretcher and having an array of openings of which a portion are plugged with a sealing compound to create a partially plugged foraminous belt. The method comprises drawing air downward through unplugged openings in the foraminous (Continued)

belt to stabilize the continuous filaments deposited on the foraminous belt, and pre-consolidating the deposited non-woven into final form.

18 Claims, 3 Drawing Sheets

Related U.S. Application Data continuation of application No. 15/493,170, filed on Apr. 21, 2017, now abandoned.

(51) Int. Cl.

| | |
|---|---|
| ***D01D 10/00*** | (2006.01) |
| ***D04H 3/005*** | (2012.01) |
| ***D04H 3/02*** | (2006.01) |
| ***D04H 3/14*** | (2012.01) |
| ***D04H 3/16*** | (2006.01) |

(52) U.S. Cl.

CPC ..... *D04H 3/02* (2013.01); *D04H 3/14* (2013.01); *D04H 3/16* (2013.01); *D10B 2401/041* (2013.01)

(56) References Cited

U.S. PATENT DOCUMENTS

| | | | |
|---|---|---|---|
| 4,741,941 | A | 5/1988 | Englebert |
| 4,789,699 | A | 12/1988 | Kieffer et al. |
| 4,970,104 | A | 11/1990 | Radwanski |
| 5,145,727 | A | 9/1992 | Potts et al. |
| 5,178,932 | A | 1/1993 | Perkins et al. |
| 5,302,220 | A | 4/1994 | Terakawa et al. |
| 5,334,289 | A | 8/1994 | Trokhan |
| 5,368,858 | A | 11/1994 | Hunziker |
| 5,369,858 | A | 12/1994 | Gilmore et al. |
| 5,399,174 | A | 3/1995 | Yeo et al. |
| 5,514,523 | A | 5/1996 | Trokhan |
| 5,575,874 | A | 11/1996 | Griesbach |
| 5,599,420 | A | 2/1997 | Yeo |
| 5,634,653 | A | 6/1997 | Browning |
| 5,643,653 | A | 7/1997 | Griesbach, III |
| 5,725,927 | A | 3/1998 | Zilg et al. |
| 5,858,504 | A | 1/1999 | Fitting |
| 5,895,623 | A | 4/1999 | Trokhan |
| 5,916,661 | A | 6/1999 | Benson |
| 6,139,941 | A | 10/2000 | Jankevics |
| 6,319,455 | B1 | 11/2001 | Kauschke et al. |
| 6,331,268 | B1 | 12/2001 | Kauschke et al. |
| 6,331,345 | B1 | 12/2001 | Kauschke et al. |
| 6,361,638 | B2 | 3/2002 | Takai |
| 6,383,431 | B1 | 5/2002 | Dobrin |
| 6,395,957 | B1 | 5/2002 | Chen |
| 6,436,512 | B1 | 8/2002 | Kauschke et al. |
| 6,632,504 | B1 | 10/2003 | Gillespie |
| 6,673,418 | B1 | 1/2004 | Deolivera |
| 6,818,802 | B2 | 11/2004 | Takai et al. |
| 6,841,037 | B2 | 1/2005 | Scherb et al. |
| 6,888,046 | B2 | 5/2005 | Toyoshima et al. |
| 7,005,044 | B2 | 2/2006 | Kramer et al. |
| 7,168,473 | B2 | 1/2007 | Geus et al. |
| 7,255,759 | B2 | 8/2007 | Debyser et al. |
| 7,507,463 | B2 | 3/2009 | Noda et al. |
| 7,553,535 | B2 | 6/2009 | Noda et al. |
| 7,578,317 | B2 | 8/2009 | Levine et al. |
| 7,662,462 | B2 | 2/2010 | Noda et al. |
| 7,897,240 | B2 | 3/2011 | Noda et al. |
| 7,954,213 | B2 | 6/2011 | Mizutani |
| 7,955,549 | B2 | 6/2011 | Noda et al. |
| 8,129,298 | B2 | 3/2012 | Motomura |
| 8,143,177 | B2 | 3/2012 | Noda |
| 8,183,431 | B2 | 5/2012 | Noda et al. |
| 8,273,941 | B2 | 9/2012 | Uematsu et al. |
| 8,304,600 | B2 | 11/2012 | Noda et al. |
| 8,574,209 | B2 | 11/2013 | Nishitani et al. |
| 8,585,666 | B2 | 11/2013 | Weisman |
| 8,758,569 | B2 | 6/2014 | Aberg et al. |
| 8,778,137 | B2 | 7/2014 | Nozaki et al. |
| 8,853,108 | B2 | 10/2014 | Ahoniemi |
| 8,865,965 | B2 | 10/2014 | Sato et al. |
| 8,906,275 | B2 | 12/2014 | Davis |
| 9,095,477 | B2 | 8/2015 | Yamaguchi et al. |
| 9,156,229 | B2 | 10/2015 | Noda et al. |
| 9,205,005 | B2 | 12/2015 | Kikuchi et al. |
| 9,453,292 | B2 | 9/2016 | Sommer et al. |
| 9,453,303 | B2 | 9/2016 | Aberg |
| 9,732,454 | B2 | 8/2017 | Davis |
| 9,750,651 | B2 | 9/2017 | Bianchi et al. |
| 9,770,371 | B2 | 9/2017 | Kanya et al. |
| 9,877,876 | B2 | 1/2018 | Huang |
| 9,903,070 | B2 | 2/2018 | Mourad et al. |
| 9,993,369 | B2 | 6/2018 | Xu |
| 10,123,916 | B2 | 11/2018 | Weisman et al. |
| 10,190,244 | B2 | 1/2019 | Ashraf |
| 10,639,212 | B2 | 5/2020 | Kanya et al. |
| 10,858,768 | B2 | 12/2020 | Ashraf et al. |
| 11,383,481 | B2 | 7/2022 | Sommer et al. |
| 11,655,563 | B2 * | 5/2023 | Sommer ..... D04H 3/14 425/72.2 |
| 2001/0029141 | A1 | 10/2001 | Mizutani |
| 2002/0043369 | A1 | 4/2002 | Vinegar et al. |
| 2002/0119720 | A1 | 8/2002 | Arora et al. |
| 2002/0153271 | A1 | 10/2002 | Mcmanus |
| 2002/0193032 | A1 | 12/2002 | Newkirk et al. |
| 2003/0085013 | A1 | 5/2003 | Burazin et al. |
| 2003/0093045 | A1 | 5/2003 | Erdman |
| 2003/0119404 | A1 | 6/2003 | Belau |
| 2003/0125687 | A1 | 7/2003 | Gubernick et al. |
| 2003/0161904 | A1 | 8/2003 | Geus et al. |
| 2003/0203162 | A1 | 10/2003 | Fenwick |
| 2003/0203196 | A1 | 10/2003 | Trokhan et al. |
| 2003/0203691 | A1 | 10/2003 | Fenwick et al. |
| 2003/0211802 | A1 | 11/2003 | Keck et al. |
| 2003/0213620 | A1 | 11/2003 | Krueger |
| 2004/0005457 | A1 | 1/2004 | Delucia et al. |
| 2004/0059309 | A1 | 3/2004 | Nortman |
| 2004/0126601 | A1 | 7/2004 | Kramer et al. |
| 2005/0148971 | A1 | 7/2005 | Kuroda et al. |
| 2006/0025737 | A1 | 2/2006 | Song |
| 2006/0087053 | A1 | 4/2006 | Odonnell |
| 2006/0105075 | A1 | 5/2006 | Otsubo |
| 2006/0135927 | A1 | 6/2006 | Zander et al. |
| 2006/0189954 | A1 | 8/2006 | Kudo |
| 2007/0026753 | A1 | 2/2007 | Neely |
| 2007/0045143 | A1 | 3/2007 | Clough |
| 2007/0045144 | A1 | 3/2007 | Wheeler |
| 2007/0179466 | A1 | 8/2007 | Tremblay |
| 2007/0298214 | A1 | 12/2007 | Noda et al. |
| 2007/0298667 | A1 | 12/2007 | Noda et al. |
| 2008/0149292 | A1 | 6/2008 | Scherb |
| 2008/0220161 | A1 | 9/2008 | Sommer et al. |
| 2009/0240222 | A1 | 9/2009 | Tomoko et al. |
| 2010/0036346 | A1 | 2/2010 | Hammons |
| 2010/0048072 | A1 | 2/2010 | Kauschke |
| 2010/0062672 | A1 | 3/2010 | Fare |
| 2010/0198013 | A1 | 8/2010 | Binmoeller |
| 2010/0224356 | A1 | 9/2010 | Moore |
| 2011/0073513 | A1 | 3/2011 | Weisman et al. |
| 2011/0119850 | A1 | 5/2011 | Mallory et al. |
| 2011/0123775 | A1 | 5/2011 | Westwood |
| 2011/0137624 | A1 | 6/2011 | Weisman et al. |
| 2011/0250378 | A1 | 10/2011 | Eaton |
| 2011/0313385 | A1 | 11/2011 | Hammons et al. |
| 2012/0004633 | A1 | 1/2012 | R. Marcelo |
| 2012/0196091 | A1 | 8/2012 | Mizutani et al. |
| 2012/0238979 | A1 | 9/2012 | Weisman et al. |
| 2012/0238982 | A1 | 9/2012 | Weisman et al. |
| 2012/0315440 | A1 | 12/2012 | Ichikawa et al. |
| 2012/0316532 | A1 | 12/2012 | Mccormick |
| 2013/0112584 | A1 | 5/2013 | Gaspari |
| 2013/0139960 | A1 | 6/2013 | Maruyama |
| 2013/0167305 | A1 | 7/2013 | Weisman et al. |
| 2013/0171421 | A1 | 7/2013 | Weisman |

(56) References Cited

U.S. PATENT DOCUMENTS

| | | | |
|---|---|---|---|
| 2013/0320584 | A1 | 12/2013 | Davis et al. |
| 2014/0044934 | A1 | 2/2014 | Bills et al. |
| 2014/0088535 | A1 | 3/2014 | Xu et al. |
| 2014/0127460 | A1 | 5/2014 | Xu |
| 2014/0163502 | A1 | 6/2014 | Arizti |
| 2014/0202711 | A1 | 7/2014 | Scott et al. |
| 2014/0234575 | A1 | 8/2014 | Mitsuno |
| 2014/0276517 | A1 | 9/2014 | Chester |
| 2014/0296815 | A1 | 10/2014 | Takken |
| 2014/0305570 | A1 | 10/2014 | Matsunaga |
| 2014/0324009 | A1 | 10/2014 | Lee |
| 2014/0343526 | A1 | 11/2014 | Knapmeyer et al. |
| 2014/0358101 | A1 | 12/2014 | Kanya et al. |
| 2015/0038933 | A1 | 2/2015 | Day |
| 2015/0173967 | A1 | 6/2015 | Kreuzer |
| 2015/0209202 | A1 | 7/2015 | Weisman et al. |
| 2015/0257943 | A1 | 9/2015 | Noel |
| 2015/0265473 | A1 | 9/2015 | Hammons et al. |
| 2015/0282999 | A1 | 10/2015 | Arizti |
| 2016/0067119 | A1 | 3/2016 | Weisman |
| 2016/0106633 | A1 | 4/2016 | Nagata |
| 2016/0129661 | A1 | 5/2016 | Arora |
| 2016/0136009 | A1 | 5/2016 | Weisman |
| 2016/0235597 | A1 | 8/2016 | Ehrnsperger et al. |
| 2016/0362825 | A1 | 12/2016 | Novarino et al. |
| 2017/0014281 | A1 | 1/2017 | Xie |
| 2017/0014291 | A1 | 1/2017 | Tao et al. |
| 2017/0027774 | A1 | 2/2017 | Ashraf |
| 2017/0029993 | A1 | 2/2017 | Ashraf |
| 2017/0029994 | A1 | 2/2017 | Ashraf |
| 2017/0056256 | A1 | 3/2017 | Smith |
| 2017/0121873 | A1 | 5/2017 | Kimura et al. |
| 2017/0137980 | A1 | 5/2017 | Kauschke et al. |
| 2017/0175313 | A1 | 6/2017 | Song et al. |
| 2017/0191198 | A1 | 7/2017 | Ashraf |
| 2017/0258650 | A1 | 9/2017 | Rosati |
| 2017/0314163 | A1 | 11/2017 | Sommer et al. |
| 2017/0348163 | A1 | 12/2017 | Lakso |
| 2018/0168893 | A1 | 6/2018 | Ashraf |
| 2018/0214318 | A1 | 8/2018 | Ashraf |
| 2018/0214321 | A1 | 8/2018 | Ashraf |
| 2018/0216269 | A1 | 8/2018 | Ashraf |
| 2018/0216270 | A1 | 8/2018 | Ashraf |
| 2018/0216271 | A1 | 8/2018 | Ashraf |
| 2018/0344544 | A1 | 12/2018 | Tally |
| 2019/0003079 | A1 | 1/2019 | Ashraf |
| 2019/0003080 | A1 | 1/2019 | Ashraf |
| 2019/0112737 | A1 | 4/2019 | Ashraf |
| 2019/0388578 | A1 | 12/2019 | Aviles |
| 2020/0038262 | A1 | 2/2020 | Aviles et al. |
| 2020/0054501 | A1 | 2/2020 | Seto et al. |
| 2020/0299881 | A1 | 9/2020 | Ashraf |
| 2021/0040661 | A1 | 2/2021 | Ashraf et al. |
| 2021/0077319 | A1 | 3/2021 | Weber et al. |
| 2021/0169710 | A1 | 6/2021 | Ashraf et al. |
| 2021/0214858 | A1 | 7/2021 | Sommer et al. |
| 2022/0074094 | A1 | 3/2022 | Ashraf et al. |

FOREIGN PATENT DOCUMENTS

| | | | |
|---|---|---|---|
| CN | 1685099 | A | 10/2005 |
| CN | 101443499 | A | 5/2009 |
| CN | 103108616 | A | 5/2013 |
| CN | 104507436 | A | 4/2015 |
| CN | 105473114 | A | 4/2016 |
| CN | 108366888 | A | 8/2018 |
| CN | 110022822 | A | 7/2019 |
| EA | 2660377 | B1 | 4/2014 |
| EP | 0418493 | A1 | 3/1991 |
| EP | 1227181 | A2 | 7/2002 |
| EP | 1234906 | A2 | 8/2002 |
| EP | 1323400 | A2 | 7/2003 |
| EP | 1338262 | A1 | 8/2003 |
| EP | 3210584 | A1 | 8/2017 |
| JP | H04327255 | A | 11/1992 |
| JP | H08508553 | A | 9/1996 |
| JP | 2003052752 | A | 2/2003 |
| JP | 2006510456 | A | 3/2006 |
| JP | 2008223214 | A | 9/2008 |
| JP | 2009136349 | A | 6/2009 |
| JP | 2011015707 | A | 1/2011 |
| JP | 48027070 | A | 11/2011 |
| JP | 48053061 | A | 1/2012 |
| JP | 2012075638 | A | 4/2012 |
| JP | 5399174 | B2 | 11/2013 |
| JP | 2013244256 | A | 12/2013 |
| JP | 2014070299 | A | 4/2014 |
| JP | 2014097257 | A | 5/2014 |
| JP | 2014515986 | A | 7/2014 |
| JP | 2014188042 | A | 10/2014 |
| JP | 2014234345 | A | 12/2014 |
| KR | 100988698 | B1 | 10/2010 |
| RU | 2388860 | C2 | 5/2010 |
| WO | 9716751 | A1 | 5/1997 |
| WO | 2003015681 | A1 | 2/2003 |
| WO | 03038168 | A1 | 5/2003 |
| WO | 03057117 | A1 | 7/2003 |
| WO | 201286730 | A1 | 6/2012 |
| WO | 2013018846 | A1 | 2/2013 |
| WO | 2013084977 | A1 | 6/2013 |
| WO | 2013099625 | A1 | 7/2013 |
| WO | 2013145966 | A1 | 10/2013 |
| WO | 2015000774 | A1 | 1/2015 |
| WO | 2015073374 | A1 | 5/2015 |
| WO | 2017105997 | A1 | 6/2017 |
| WO | 2017110695 | A1 | 6/2017 |
| WO | 2020226951 | A1 | 11/2020 |

OTHER PUBLICATIONS

All Office Actions; U.S. Appl. No. 15/221,624, filed Jul. 28, 2016.
All Office Actions; U.S. Appl. No. 15/221,625, filed Jul. 28, 2016.
All Office Actions; U.S. Appl. No. 15/221,626, filed Jul. 28, 2016.
All Office Actions; U.S. Appl. No. 15/493,170, filed Apr. 21, 2017.
All Office Actions; U.S. Appl. No. 16/214,526, filed Dec. 10, 2018.
All Office Actions; U.S. Appl. No. 17/076,847, filed Oct. 22, 2020.
All Office Actions; U.S. Appl. No. 18/192,741, filed Mar. 30, 2023.
All Office Actions; U.S. Appl. No. 18/301,526, filed Apr. 17, 2023.
All Office Actions; U.S. Appl. No. 15/221,628, filed Jul. 28, 2016.
All Office Actions; U.S. Appl. No. 17/213,873, filed Mar. 26, 2021.
Extended European Search Report and Search Opinion for 16167804.0; dated Oct. 31, 2016; 9 pages.
U.S. Appl. No. 18/192,741, filed Mar. 30, 2023, to Arman Ashraf et al.
U.S. Appl. No. 18/301,526, filed Apr. 17, 2023, to Arman Ashraf et al.

* cited by examiner

METHODS OF MAKING A NONWOVEN FROM CONTINUOUS FILAMENTS

CROSS REFERENCE TO RELATED APPLICATIONS

This application is a continuation of, and claims priority under 35 U.S.C. § 120 to, U.S. patent application Ser. No. 17/213,873, filed on Mar. 26, 2021, which is a continuation and claims priority to U.S. patent application Ser. No. 15/493,170, filed on Apr. 21, 2017, which claims priority to European Patent Application No. 16167804.0-1308, filed on Apr. 29, 2016, which are all hereby incorporated by reference herein in their entirety.

FIELD

The present invention relates to making a nonwoven. More particularly this invention concerns making nonwoven from continuous filaments.

BACKGROUND

An apparatus for making nonwoven from continuous filaments, in particular thermoplastic monofilament, typically has at least one spinning device for spinning the filaments being provided, a device for cooling and stretching the spun filaments, and a device for depositing the drawn filaments to form the nonwoven. Continuous filaments differ because of their quasi-endless length from staple fibers that have much lesser lengths, for instance of 10 mm to 60 mm.

An apparatus and method for making nonwoven of the type described above are known in practice in various embodiments. It is often desirable to produce structured nonwoven or spun nonwoven with a "3D structure" with varying local thicknesses or porosities. Various provisions for this purpose are also known in practice. For instance, it is already known to generate a suitable nonwoven structure by embossing or mechanical reshaping of the nonwoven. The deformability of the nonwoven can as a rule be achieved only by preheating the strip of nonwoven to the softening range of the plastic. The deformation then also causes compacting; the overall strip of nonwoven becomes flatter, which impairs the desired soft hand of the strip of nonwoven.

In particular for short fibers or staple fibers, it is also known to relocate the short-fiber deposit, for instance by compressed air, and then to perform hot-air consolidation. However, this limits the choice of material for the strip of nonwoven, since many kinds of polymer fibers cannot be hot-air-consolidated without problems. In the case of continuous filaments, these provisions have furthermore not proven themselves over time.

Another method is based on the use of a structured and partly air-permeable deposition belt (EP 0 696 333 [U.S. Pat. No. 5,575,874]). The deposition belt is equipped with air-permeable plugged openings, and these plugged openings have protrusions that project from the mesh belt surface. The deposited filaments are pre-consolidated on the deposition belt with an adhesive, for instance by hot-air consolidation, and then the nonwoven is pulled off. The structure of this nonwoven is equally attained by demolding of the plugged opening protrusions that project from the surface of the deposition belt. These provisions are disruptive and likely to produce flaws and have not proven themselves in practice.

OBJECTS

It is therefore an object of the present invention to provide an improved method and apparatus for making nonwoven from continuous filaments.

Another object is the provision of such an improved method and apparatus for making nonwoven from continuous filaments that overcomes the above-given disadvantages In addition, an object of the invention is to provide an apparatus of the type defined above with which a nonwoven with a 3D structure can be produced in a simple and efficient way, and this nonwoven is distinguished by an aesthetically perfect, replicable 3D structure and furthermore has a sufficiently soft hand.

Yet another object is to provide a suitable method of making the nonwoven, as well as a corresponding nonwoven.

SUMMARY

An apparatus for making nonwoven has according to the invention a spinning device for spinning continuous filaments and moving the spun filaments in a vertical travel direction along a vertical travel path and a mesh belt below the spinning device, traveling in a horizontal direction, and having a multiplicity of vertically throughgoing openings distributed generally uniformly over its surface and of which a portion are plugged. A cooler and a stretcher are provided along the path downstream of the spinning device and above the belt for cooling and stretching the filaments and depositing the cooled and stretched filaments at a predetermined deposition location on the belt. A blower underneath the belt at the deposition location aspirates air through the openings and thereby holds the deposited filaments down on the belt. The openings are dimensioned and the air is aspirated through the belt such that, if none of the openings were plugged, air would pass through the belt at 350 to 1050 cfm, but actually so many of the openings are plugged that air passes through the belt at 150 to 700 cfm.

It is within the scope of the invention that the air permeability of the unplugged mesh belt amounts to 300 to 1100 cfm, preferably 350 to 1050 cfm, and preferably 400 to 1000 cfm, and the air permeability of the partly plugged mesh belt amounts to 150 to 700 cfm, preferably 250 to 600 cfm, and preferably 350 to 500 cfm. The air permeability of the partly plugged mesh belt ranges especially preferably from 300 to 500 cfm and very particularly preferably from 350 to 500 cfm. In the context of the invention, the term "unplugged mesh belt" means a mesh belt, according to the invention with only open or unplugged mesh belt openings, in other words all its openings clear. In this respect, the unplugged mesh belt serves here merely as a reference, since according to the invention a partly plugged mesh belt or a mesh belt with partly plugged mesh belt openings is used. It is understood that the air permeability of the unplugged mesh belt is greater than the air permeability of the partly plugged mesh belt.

The air permeability is indicated here in cfm (cubic feet per minute). The measurement of the air permeability is preferably done on a circular area of 38.3 $cm^2$ at a pressure difference of 125 Pa. Advantageously, a plurality of individual measurements is made (ten are recommended) and the air permeability is then found by averaging the individual measurements. It is within the scope of the invention that the air permeability is measured in accordance with ASTM D 737. It is furthermore within the scope of the invention that the mesh belt has a textile of filaments that intersect one another. Advantageously, the filaments of the mesh belt are plastic filaments, in particular monofilaments, and/or metal filaments. Filaments of round or nonround cross section can be used. The textile of the mesh belt can be a single- or multilayer. A multilayer textile is understood here to mean the surface of the uppermost layer of the textile below the mesh belt surface. In a preferred embodiment, the mesh belt has only one textile layer.

A recommended embodiment of the apparatus of the invention is characterized in that the mesh belt has a textile comprising warp and weft filaments that define the mesh belt openings. It is recommended that the textile of the mesh belt has a web density of 20 to 75 warp filaments per 25 mm and preferably 30 to 55 warp filaments per 25 mm, as well as of 10 to 50 weft filaments per 25 mm, preferably 10 to 40 weft filaments per 25 mm.

It is within the scope of the invention that a plurality of or many open mesh belt openings are distributed over the mesh belt surface, and that in the same way a plurality of or many plugged mesh belt openings are distributed over the mesh belt surface. A plugged mesh belt opening or a plurality of plugged mesh belt openings adjoining one another form a plugged opening of the mesh belt. It is recommended that the diameter d or the minimum diameter d of a plugged opening of the mesh belt amounts to at least 1.5 mm, preferably at least 2 mm, and a maximum of 8 mm, preferably a maximum of 9 mm and in particular a maximum of 10 mm. Advantageously, the ratio of the air permeability of unplugged mesh belt to the air permeability of the partly plugged mesh belt amounts to 1.2 to 4, preferably 1.3 to 3.5, preferably 1.5 to 3, and especially preferably 1.8 to 2.8.

The plugged mesh belt openings or the plugged openings dictate that the mesh belt, in contrast to the unplugged mesh belt, no longer has a homogeneous air permeability. In this respect, the invention is based on the discovery that the plugged openings directly impose a lateral motion on the air above the mesh belt that is flowing to the mesh belt. The filaments to be deposited that are contained in this air stream at least partially follow this lateral displacement of air and as a result are preferably deposited onto the open or unplugged areas of the mesh belt. In this way, a nonwoven with varying local weights per unit of surface area or with a defined 3D structure is created.

In an especially recommended embodiment of the invention, the plugged mesh belt openings or the plugged openings are distributed in a regular pattern over the mesh belt. It is recommended that the mesh belt openings or the plugged openings have constant spacings from one another in at least one direction in space. In a preferred embodiment of the invention, the plugged openings are arrayed in punctate fashion. Punctate here means in particular that the diameter of a plugged opening is similar or comparable or essentially the same in all directions in space. A time-tested variant is distinguished by the fact that the punctate plugged openings are distributed at regular spacings over the mesh belt or the mesh belt surface. Advantageously, the minimum diameter d of these punctate plugged openings amounts to at least 2 mm, preferably at least 2.5 mm, and especially preferably at least 3 mm and a maximum of 8 mm, preferably a maximum of 9 mm and highly preferably a maximum of 10 mm.

In a further preferred embodiment of the invention, the plugged openings are arrayed in lines. It is within the scope of the invention that the plugged-opening lines are as a rule not embodied exactly rectilinearly or linearly and that as a rule, above all, the edges of the plugged-opening lines are not exactly rectilinear or linear. In a time-tested variant embodiment, the plugged-opening lines have constant or essentially constant spacings from one another. Advantageously, the plugged-opening lines are located parallel or essentially parallel to one another. It is also within the scope of the invention that the plugged-opening lines are each dashed lines, and parts of plugged-opening lines and linear opened mesh belt areas connecting the portions are located on a line. In one embodiment of the invention, plugged-opening lines intersect, and preferably the plugged-opening lines extending in one direction are parallel to one another, and advantageously the plugged-opening lines extending in a second direction are (likewise) parallel to one another. It is also within the scope of the invention that the plugged-opening lines of a mesh belt, in various areas of the mesh belt or of the mesh belt surface, have different densities and/or different widths (minimum diameters d). The plugged-opening lines can also be curved or arcuate plugged-opening lines. The width (minimum diameter d) of a linear plugged opening preferably amounts to at least 1.5 mm, preferably at least 2 mm, and a recommended maximum is 8 mm and in particular 9 mm.

In a variant of the invention, punctate and plugged-opening lines can be combined with one another. In principle, various geometrical embodiments for the plugged openings are conceivable, and these various embodiments can also be combined with one another. Opened mesh belt areas can be surrounded by plugged openings or by plugged mesh belt areas, or vice versa.

It is within the scope of the invention that to create the plugged mesh belt openings or to create the plugged openings, sealing compounds of plastic or polymers are used. To create the plugged openings, advantageously molten or liquid plastic is introduced into the textile of the mesh belt or into the mesh belt openings of the mesh belt. The sealing compound, in a variant embodiment, can be photosensitive plastic, or a photosensitive multicomponent system, which is first introduced into the textile of the mesh belt and is then hardened, and in particular hardened under the influence of light and preferably under the influence of UV radiation. It is within the scope of the invention that the sealing compound penetrates the mesh belt openings of the mesh belt textile, and that the plugged opening patterns formed depend on the type of web and the web density. Advantageously, the mesh belt textile is formed of monofilaments having a diameter of 0.2 to 0.9 mm, preferably 0.3 to 0.7 mm. It is recommended that a plugged opening is created by the closure of mesh belt openings between at least 2 warp filaments and/or weft filaments, preferably between or via at least 3 warp filaments and/or weft filaments.

An especially recommended embodiment of the invention is characterized in that the sealing compound of the plugged openings is located only in and/or below the plane of the mesh belt surface and does not project past the plane of the mesh belt surface. In a variant, the sealing compound extends over the entire thickness or essentially over the entire thickness of the mesh belt or mesh belt textile. In another variant embodiment, the sealing compound of a plugged opening or of a plugged mesh belt opening extends only through part of the thickness of the mesh belt textile. Preferably the sealing compound of a plugged mesh belt opening or the plugged opening of the mesh belt surface extends downward, and then the sealing compound, as described above, can extend either over the entire thickness of the mesh belt or over only a portion of the thickness of the mesh belt. Advantageously, the sealing compound is located over at least 30%, preferably at least 33%, of the thickness of the mesh belt or mesh belt textile, and the sealing compound, as noted above, preferably extends from the mesh belt surface downward.

In an especially recommended embodiment of the invention, at least 25%, and preferably at least 30%, of the mesh belt openings of the mesh belt used within the scope of the invention are plugged. Advantageously, a maximum of 67%, and preferably a maximum of 60%, of the openings of the mesh belt are plugged.

One embodiment of the invention is distinguished in that the sealing compound of the plugged mesh belt openings, or of the plugged openings, projects from the mesh belt surface, and specifically preferably by a maximum of 1.5 mm, advantageously a maximum of 1.0 mm, preferably a maximum of 0.8 mm, and highly preferably a maximum of 0.6 mm. Especially preferably, the sealing compound of a plugged mesh belt opening or of a plugged opening projects by a maximum of 0.3 mm to 0.6 mm from the mesh belt surface. An especially recommended embodiment of the invention, however, is characterized in that the sealing compound is located in and/or below the mesh belt surface of the mesh belt and does not project past the mesh belt surface.

It has been explained above that the plugged openings effect a lateral air motion in the air flowing through the mesh belt, and that, because of this lateral motion, the filaments in the air stream follow the stream and are thus deposited preferably onto the open mesh belt areas. The invention is based on the recognition that this shift in location can be effectively intensified if the sealing compound of the plugged openings projects upward past the mesh belt surface. Because of the crest created as a result, the deposited filaments can slide into the adjacent open mesh belt area, and the differences in the filament density or weight per unit of surface area can as a result be even more markedly pronounced. The invention is further based on the recognition that limits are set on the height of the area projecting from the mesh belt, since an area projecting too high is associated with reduced stability of the filament deposition. Finally, the invention is based on the recognition that an area projecting from the mesh belt surface should project from the mesh belt surface preferably by a maximum of 0.6 mm, and highly preferably by a maximum of 0.5 mm.

The apparatus of the invention has at least one spinning device or spinneret with which the continuous filaments are spun. In an especially preferred embodiment of the invention, spunbond nonwoven is produced with the apparatus of the invention and to that extent the apparatus is designed as a spunbond apparatus. In the process, monocomponent and/or multicomponent or bicomponent filaments are created as continuous filaments. The multicomponent or bicomponent filaments can be continuous filaments with a core-and-jacket configuration, or continuous filaments with a tendency to become curly, for instance with a side-to-side configuration. In an especially preferred embodiment of the invention, the continuous filaments produced with the apparatus and the method of the invention comprise at least one polyolefin, in particular polypropylene and/or polyethylene.

An apparatus according to the invention in the form of a spunbond apparatus has at least one cooler for cooling the filaments and at least one stretcher for stretching the filaments.

In an especially recommended embodiment that has very particular significance in the context of the invention, at least one cooler for cooling the filaments and at least one stretcher for stretching the cooled filaments is provided, and the cooler and the stretcher form a closed subassembly, and except for the supply of cooling air in the cooler, no further supply of air into this closed subassembly takes place. This sealed embodiment of the apparatus of the invention has proved itself especially well in conjunction with the mesh belt used according to the invention.

A recommended embodiment of the invention is further characterized in that, between the stretcher and the deposition device, or mesh belt, there is at least one diffuser. The continuous filaments emerging from the stretcher are passed through the diffuser and then deposited on the deposition device or on the screen.

A special variant of the invention is distinguished in that between the stretcher and the mesh belt, there are at least two diffusers, preferably two diffusers one after the other in the direction of filament flow. Advantageously, at least one secondary air-inlet gap for the entry of ambient air is provided between the two diffusers. The embodiment having the at least one diffuser or the at least two diffusers and the secondary air inlet gap has proved itself especially well in combination with the mesh belt of the invention.

In the apparatus of the invention or in the context of the method of the invention, air is aspirated through the mesh belt or aspirated through the mesh belt in the filament-travel direction. To that end, advantageously at least one aspirating blower is provided below the mesh belt. Advantageously, at least two and preferably at least three and preferably three aspiration areas separate from one another are located one after the other in the travel direction of the belt. In the deposition area of the continuous filaments or of the nonwoven, a main suction area is preferably provided in which air is aspirated with a higher suction speed than in the at least one further suction area or than in the two further suction areas. Advantageously, in the main suction area the air is aspirated through the mesh belt at a suction speed of 5 to 30 m/s. This is the average suction speed with respect to the mesh belt surface. A proven embodiment of the invention is distinguished in that at least one further suction area is located downstream of the main suction area in the travel direction of the belt, and that the suction speed of the air sucked into this further suction area is less than the suction speed in the main suction area. It is recommended that a first suction area be provided upstream of the main suction area in terms of the travel direction of the belt, and that a second suction area is downstream of the main suction area in terms of the travel direction of the belt. Advantageously, the suction speed in the main suction area or in the deposition area of the nonwoven is set such that it is higher than the suction speeds in the other two suction areas. The suction speeds in the first and/or second suction area, in one embodiment of the invention, are between 2 and 10 m/s, in particular between 2 and 5 m/s.

A recommended embodiment of the invention is characterized in that the nonwoven deposited on the mesh belt is pre-consolidated, and especially preferably is pre-consolidated with the aid of at least one compacting roller as a pre-consolidation device. Advantageously, the at least one compacting roller is heated. In another variant embodiment of the invention, the pre-consolidation of the nonwoven can be done on the mesh belt in the form of hot-air consolidation as well.

It is within the scope of the invention that a final consolidation of the nonwoven produced according to the invention is done. In principle, the final consolidation can also be done on the mesh belt. In a preferred embodiment explained hereinafter, however, the nonwoven is removed from the mesh belt and then subjected to the final consolidation.

It is understood that the strip of nonwoven deposited on the mesh belt must be separated again or removed from the mesh belt. Advantageously, this separation of the strip of nonwoven from the mesh belt is done after the pre-consolidation and preferably before a final consolidation. A very particularly preferred embodiment of the invention is characterized in that for separating the nonwoven from the mesh belt, air (separating air) is blown from below through the mesh belt, that is, against the underside of the nonwoven. Preferably, a separate blower is provided for this purpose, and it is recommended that the air be blown in downstream, in terms of the travel direction of the belt, from the at least one suction area or downstream of the suction areas and above all downstream of the deposition area of the nonwoven. Within the scope of the invention, separating the nonwoven or in other words locating the blower for separating the nonwoven from the mesh belt in the travel direction of the belt downstream of at least one pre-consolidation device and in particular downstream of at least one compacting roller has proved itself especially well. Advantageously, the separating air is blown in, in the travel direction of the strip of nonwoven, shortly upstream of the position at which the filament that has been deposited is removed from the mesh belt anyway. In a recommended embodiment of the invention, air or separating air is blown in at an air speed of between 1 and 40 m/s in order to remove the nonwoven. Preferably, in addition, at least one support face for the nonwoven subjected to the separating air is provided above the mesh belt. In one embodiment, this is an air-permeable support face that in one variant embodiment is vacuumed actively. For example, a permeable co-rotating drum whose surface is preferably formed by a metal textile can be used as the support face. In addition or alternatively, an additional mesh belt moving jointly with the mesh belt and located above the mesh belt can be provided as the support face. It is within the scope of the invention that the support face, for instance the support face a drum or as an additional mesh belt, is evacuated and preferably from above, so that the separating air blown in from below is aspirated through the support face.

For blowing the separating air in so as to separate the strip of nonwoven from the mesh belt, at least one blow-in gap extending transversely to the travel direction of the belt can be located below the mesh belt. The gap width may amount to from 3 to 30 mm. It is within the scope of the invention that the gap width of the blow-in gap is set such that the nonwoven deposited on the mesh belt is merely lifted in order to separate the nonwoven, without thereby being destroyed.

It is within the scope of the invention that the nonwoven, preferably after a pre-consolidation and preferably after being separated from the mesh belt, is subjected to final consolidation. The final consolidation can in particular be done with at least one calendar or at least heated calendar. In principle, the final consolidation can also be done in some other way, for instance as water-jet consolidation, mechanical needling, or hot-air consolidation.

One embodiment of the invention is distinguished in that with an apparatus of the invention, a laminate of spunbond nonwoven and a melt-blown nonwoven can be produced. From there, it is within the scope of the invention to use a spunbond/melt-blown/spunbond (SMS) apparatus. In such an apparatus, to spin the individual nonwoven, two spunbond beams and one melt-blown beam are used. For such a combination, the apparatus and the method of the invention have proved themselves especially well.

The subject of the invention is also a nonwoven of continuous filaments, in which the continuous filaments preferably or essentially are thermoplastic, and the nonwoven is in particular produced by an apparatus and/or a method of the invention. It is within the scope of the invention that the continuous filaments of this nonwoven have a titer of 0.9 to 10 denier. The filaments can also have a diameter of 0.5 to 5 μm. The nonwoven can be a spunbond nonwoven or a melt-blown nonwoven. A spunbond nonwoven is especially preferred.

The invention is based on the discovery that with the apparatus and the method of the invention, a structured spun-nonwoven with locally varying weights per unit of surface area can be made in a simple and cost-effective way. Within the scope of the invention it is possible, in a functionally safe and secure and relatively uncomplicated way, to produce nonwoven without having to sacrifice additional favorable properties. In particular, in comparison to the prior art, 3D-structured nonwoven with a soft hand can be produced in a simple and replicable way. The properties of the nonwoven can be varied to meet requirements in a targeted and problem-free way. As a result, the apparatus and the method of the invention are distinguished by low material and labor costs and functional safety and security.

BRIEF DESCRIPTION OF THE DRAWING

The above and other objects, features, and advantages will become more readily apparent from the following description, reference being made to the accompanying drawing in which.

DESCRIPTION

Figure 1:
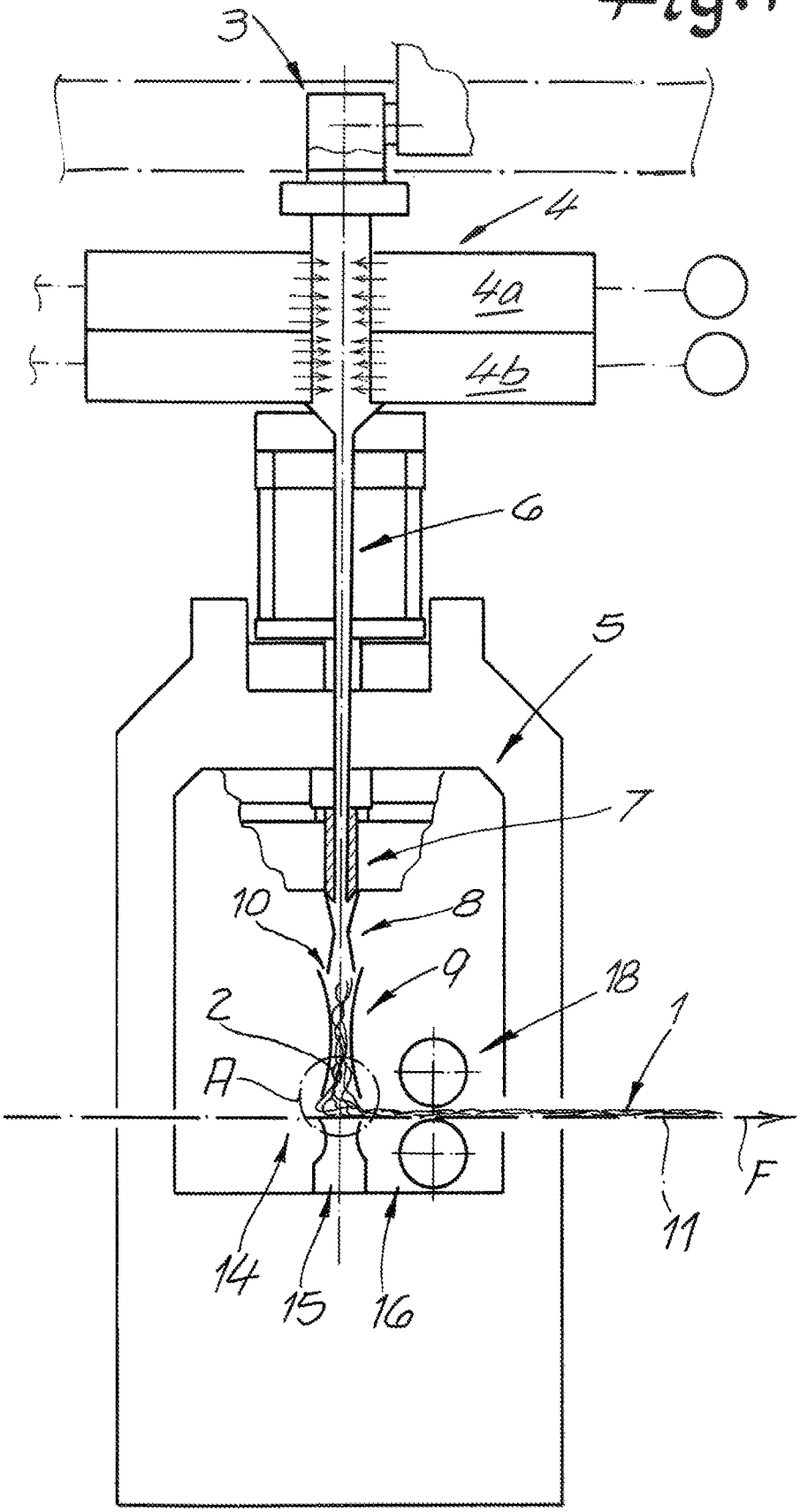
FIG. 1 is a vertical section through an apparatus of the invention.
Figure 2:
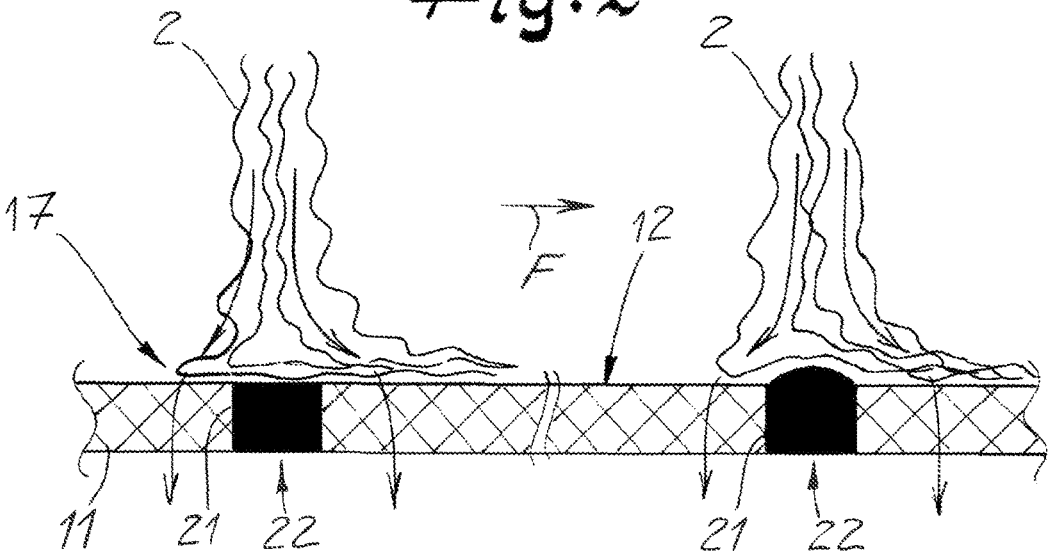
FIG. 2 is an enlarged view of the detail shown at A in FIG. 1.

The drawings shows an apparatus according to the invention for making nonwoven 1 from continuous filaments 2. In a particularly preferred embodiment and in this illustrated embodiment, this is a spunbond apparatus for making spunbond nonwoven 1 or spun nonwoven 1. The continuous filaments 2 preferably are of thermoplastic or essentially of thermoplastic. In the apparatus of the invention, the continuous filaments 2 are spun with the aid of a spinning device a spinneret 3. After that, the continuous filaments 2 are cooled in a cooler 4. This cooler 4 preferably and in the illustrated embodiment has two compartments 4*a* and 4*b*, one above the other or one after the other in the filament-travel direction, and that introduce cooling air of a variable temperature into the filament flow chamber. Downstream of the cooler 4 in the filament-travel direction is a stretcher 5 that preferably and in the illustrated embodiment has both an intermediate passage 6 that narrows in the flow direction of the continuous filaments 2 and a stretching passage 7 at the downstream end of the intermediate passage. Preferably and in the illustrated embodiment, the unit comprising the cooler 4 and the stretcher 5 is a plugged system. In this plugged system, except for the supply of cooling air or processing air, there is no further air supply in the cooler 4.

In a preferred embodiment of the invention and in the illustrated embodiment, a diffuser 8, 9 is connected to the stretcher 5 downstream in the filament-travel direction. Advantageously and in the illustrated embodiment, two diffusers 8, 9 are provided, located either one below the other or one after the other. It is recommended that an ambient air inlet gap 10 be provided between the two diffusers 8, 9 for the entry of ambient air. It is within the scope of the invention that the continuous filaments 2, downstream of the diffusers 8, 9, are deposited on a deposition device in the form of a mesh belt 11. It is furthermore within the scope of the invention that this is a continuously circulating mesh belt 11.

The mesh belt 11 has a mesh belt surface 12 with many mesh belt openings 13 distributed over the surface 12. According to the invention, air is aspirated through the mesh belt surface 12, or in other words through the (open) mesh belt openings 13. For that purpose, at least one suction blower, not shown in detail in the drawings, is located below the mesh belt 11. Preferably and in the illustrated embodiment, in the travel direction of the belt there are three separate suction areas 14, 15, 16 one after the other. In the suction area 17 of the continuous filaments 2, a main suction area 15 is preferably provided in which air is aspirated through the mesh belt 11, for instance at a suction speed or a mean suction speed of 5 to 30 m/s. Advantageously, the suction speed in the main suction area 15 is set such that it is higher than the suction speed in the remaining suction areas 14 and 16. A first suction area 14 is provided upstream of the main suction area 15, and a second suction area 16 is downstream of the main suction area 15. Advantageously and in the illustrated embodiment, a compacting device 18 with two compacting rollers 19, 20 is provided along the second suction area 16 for compacting or pre-consolidating the nonwoven 1. As recommended and in the illustrated embodiment, at least one of the compacting rollers 19, 20 is a heated compacting roller 19, 20.

According to the invention, some of the mesh belt openings 13 of the mesh belt 11 are plugged. To that extent, the result is plugged mesh belt openings 21 or plugged points 22 in the mesh belt that are formed by a single plugged mesh belt opening 21 or a plurality of adjoining plugged mesh belt openings 21. It is understood that the air permeability of the unplugged mesh belt 11 (solely open mesh belt openings 13) is greater than the air permeability of the mesh belt 11 that is provided with plugged mesh belt openings 21. For instance, the air permeability of the unplugged mesh belt amounts to 600 cfm, and the air permeability of the plugged mesh belt 11—that is, the air permeability of the mesh belt 11 with some plugged mesh belt openings 21—is only 350 cfm. The ratio of the air permeability of the unplugged mesh belt 11 to the air permeability of the partly plugged mesh belt 11 is preferably 1.2 to 3. The air permeability is measured in particular crosswise to the mesh belt surface 12 in a circular surface of the mesh belt that is 38.3 $cm^2$ in area, at a pressure difference of 125 Pa.

Preferably and in the illustrated embodiment, the mesh belt 11 has a textile that comprises warp filaments 23 and weft filaments 24 that define the mesh belt openings 13. The diameter D or the minimum diameter D of a mesh belt opening 13 may amount to 0.5 mm in the illustrated embodiment. Advantageously, this is the diameter D with respect to filaments or woven filaments located on the surface or in a surface layer of the mesh belt or mesh belt textile. It is recommended that the textile of the mesh belt 11 have a web density of 20 to 75 warp filaments per 25 mm and 10 to 50 weft filaments per 25 mm.

Figure 3A:
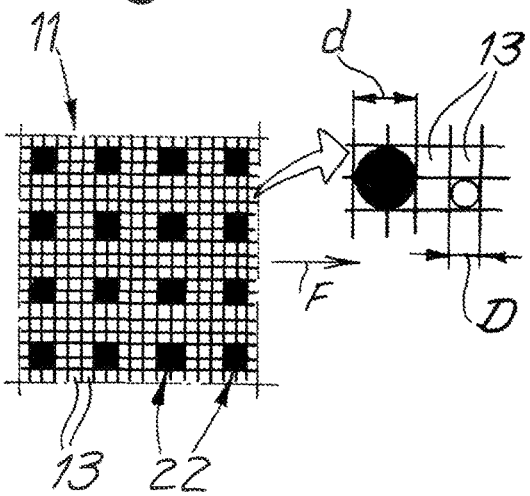
FIG. 3*a* is a top view of a first embodiment of a mesh belt used according to the invention.
Figure 3C:
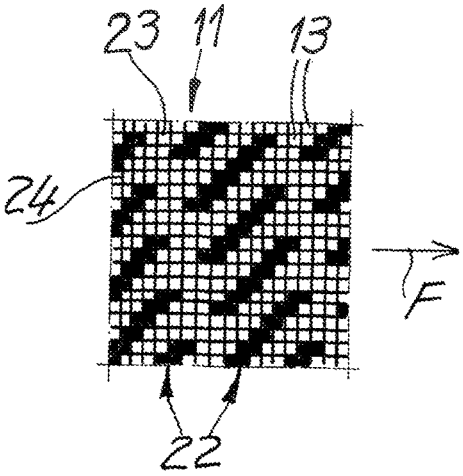
FIGS. 3*b*, 3*c*, and 3*d* are views like FIG. 3*a* of second, third, and fourth embodiments of the invention.
Figure 3B:
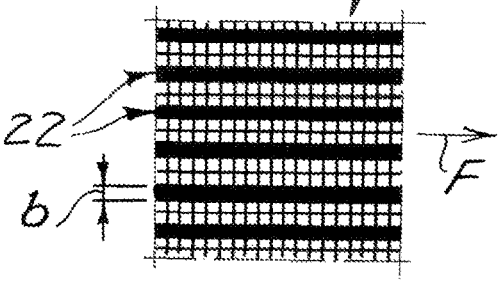
Figure 3D:
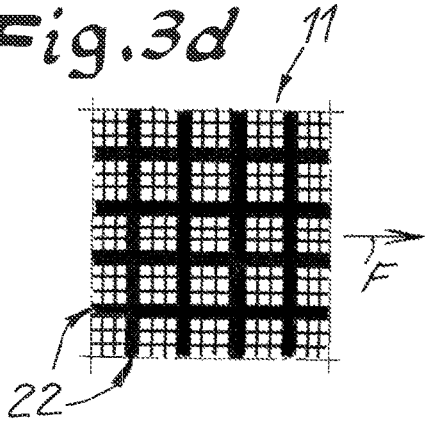

In a preferred embodiment of the invention, the plugged openings 22 in the mesh belt 11 are arrayed in punctate and/or linear form. FIG. 3*a* shows the punctate embodiment of plugged openings 22 in the mesh belt 11. The (least) diameter d of such a punctate plugged opening 22 may amount to 2 mm in the illustrated embodiment. In the illustrated embodiment of FIG. 3*b*, plugged-opening lines 22 are shown. The least width b of the plugged-opening lines 22 may amount to 2 mm as well in the illustrated embodiment. FIG. 3*c* shows a further embodiment with interrupted plugged-opening lines 22. The plugged-opening lines 22 can furthermore, in a manner not shown, also be curved or bowed lines. In FIG. 3*d*, an additional illustrated embodiment is shown with intersecting plugged-opening lines 22. This embodiment, too, has proved itself. FIGS. 3*a*, 3*b* and 3*d* furthermore show embodiments in which the plugged openings 22 are symmetrical to the longitudinal direction or travel direction of the belt 11. The travel direction F of the mesh belt 11 is indicated in FIGS. 3*a* through 3*d* by an arrow. Conversely, the embodiment of FIG. 3*c* is not symmetrical to the longitudinal direction or travel direction F of the mesh belt 11. The embodiments that are symmetrical with respect to the longitudinal direction or travel direction F are preferred in the context of this invention.

Figure 4:
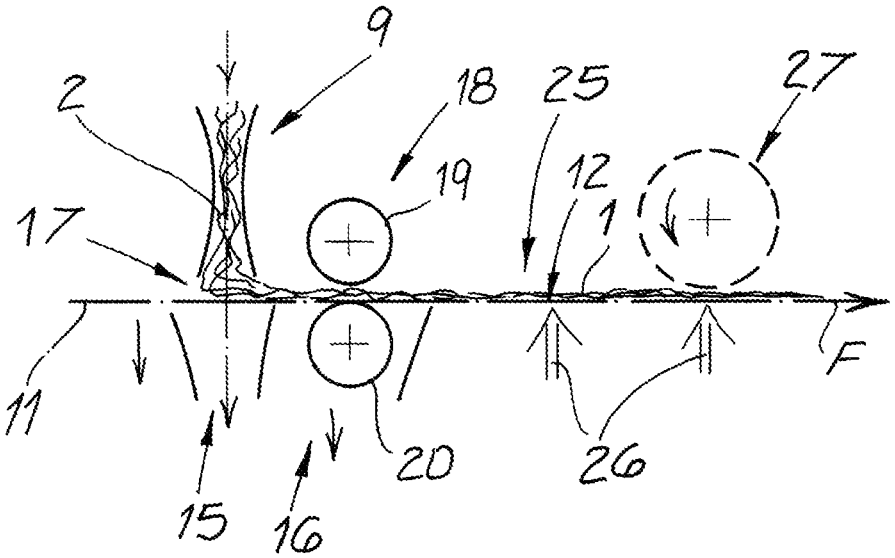
FIG. 4 is an enlarged detail of FIG. 1 in a first embodiment.

In FIG. 4, an especially recommended embodiment of the apparatus of the invention is shown. The continuous filaments 2 emerging from the diffuser 9 are deposited on the mesh belt surface 12 in the deposition area 17 of the mesh belt 11. The main suction area 15 for aspirating the processing air through the mesh belt 11 or through the mesh belt surface 12 is located below the deposition area 17. Downstream of the main suction area 15 is the second suction area 16 in which processing air is aspirated at what in comparison to the main suction area 15 is a lower air speed. The compacting device 18 with the two compacting rollers 19, 20 is provided above the second suction area 16. A separation area 25 is then downstream in the travel direction of the nonwoven 1. In this separation area, the nonwoven 1 or the pre-consolidated nonwoven 1 is released/separated from the mesh belt 11 or in other words from the mesh belt surface 12. To that end, air is blown from below, or in other words against the underside of the nonwoven 1 and up through the mesh belt 11. This has been indicated in FIGS. 4 and 5 by arrows 26. In a recommended embodiment and in the illustrated embodiment of FIG. 4, the nonwoven 1 subjected to the separating air is braced by an air-permeable drum 27 co-rotating in the travel direction of the belt 11. The drum can be positioned at a spacing of 0.5 to 5 mm, for instance, above the mesh belt surface 12. The surface of the drum 27 can be for example a metal textile. Instead of the drum, an additional mesh belt (not shown) jointly rotating in the travel direction of the belt 11 could also be used.

Figure 5:
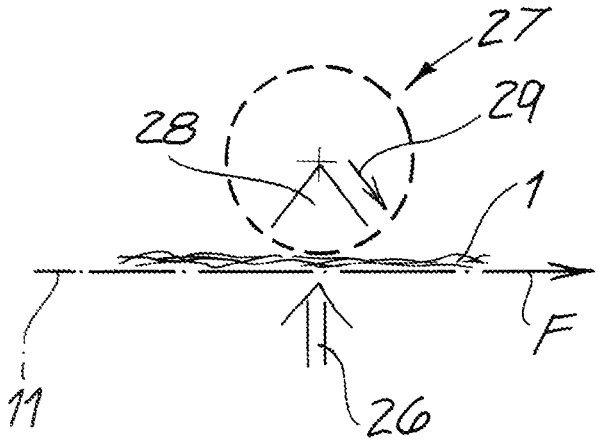
FIG. 5 is the same detail as FIG. 4 but in a second embodiment.

FIG. 5 shows a further embodiment of a drum 27 provided for bracing the nonwoven 1 subjected to the separation air. In this illustrated embodiment, the drum 27 has a suction area 28 for receiving the separation air, and supporting air is additionally blown in, in the direction of the mesh belt 11 or of the nonwoven 1, in order to prevent the continuous filaments 2 or nonwoven 1 from sticking to the drum 27. The supporting air is symbolized in FIG. 5 by an arrow 29

What is claimed is:

1. A method of making a nonwoven from continuous filaments comprising the steps of:

spinning the continuous filaments from a spinneret to move along a vertical travel path in a vertical travel direction;

cooling and stretching the filaments downstream of the spinneret in a cooler and a stretcher;

depositing the cooled and stretched filaments at a deposition location on a foraminous belt moving horizontally underneath the cooler and stretcher and having an array of openings of which a portion are plugged with a sealing compound to create a partially plugged foraminous belt;

wherein air permeability of an unplugged foraminous belt is between about 300 cfm to about 1100 cfm, wherein air permeability of the partially plugged foraminous belt is between about 150 cfm to about 700 cfm, wherein a ratio of the air permeability of the unplugged foraminous belt to the air permeability of the partially plugged foraminous belt is between about 1.2 and about 4, wherein the sealing compound is arranged in and underneath the foraminous belt and does not project upward past a foraminous belt surface, and wherein the foraminous belt comprises a woven fabric comprising warp threads and weft threads delimiting the array of openings;

drawing air downward through unplugged openings in the foraminous belt to stabilize the continuous filaments deposited on the foraminous belt; and pre-consolidating the nonwoven into final form.

2. The method of claim 1, wherein the nonwoven is produced as a spunbond nonwoven.

3. The method of claim 1, wherein the air is aspirated through the deposition location at an aspiration speed of about 5 m/s to about 25 m/s.

4. The method of claim 1, comprising the step of separating the nonwoven from the foraminous belt.

5. The method of claim 1, wherein the air permeability of the unplugged foraminous belt is between about 350 cfm to about 1050 cfm.

6. The method of claim 1, wherein the air permeability of the unplugged foraminous belt is between about 400 cfm to 1000 cfm.

7. The method of claim 1, wherein the air permeability of the partially plugged foraminous belt is between about 250 cfm to about 600 cfm.

8. The method of claim 1, wherein the sealing compound comprises plastics or polymers.

9. The method of claim 1, wherein the sealing compound is photosensitive.

10. The method of claim 1, wherein a smallest diameter of a plugged opening of the foraminous belt is between about 1.5 mm and about 10 mm.

11. The method of claim 1, wherein the ratio of the air permeability of the unplugged foraminous belt to the air permeability of the partially plugged foraminous belt is between about 1.3 and about 3.5.

12. The method of claim 1, wherein the ratio of the air permeability of the unplugged foraminous belt to the air permeability of the partially plugged foraminous belt is between about 1.3 and about 3.

13. The method of claim 1, wherein the ratio of the air permeability of the unplugged foraminous belt to the air permeability of the partially plugged foraminous belt is between about 1.8 and about 2.8.

14. The method of claim 1, wherein plugged openings are distributed in a regular pattern over the foraminous belt.

15. The method of claim 1, wherein pre-consolidating the non-woven further comprises:

pre-consolidating the nonwoven on the partially plugged foraminous belt using a compacting roller; and heating the compacting roller.

16. The method of claim 1, comprising, after the cooling and stretching step, but before the depositing step, diffusing the continuous filaments downstream of the stretcher using a diffuser.

17. The method of claim 1, comprising directing air toward the nonwoven downstream of the deposition location.

18. A method of making a nonwoven from continuous filaments comprising the steps of:

spinning the continuous filaments from a spinneret to move along a vertical travel path in a vertical travel direction;

cooling and stretching the filaments downstream of the spinneret in a cooler and a stretcher;

depositing the cooled and stretched filaments at a deposition location on a foraminous belt moving horizontally underneath the cooler and stretcher and having an array of openings of which a portion are plugged with a sealing compound to create a partially plugged foraminous belt;

wherein air permeability of an unplugged foraminous belt is between about 300 cfm to about 1100 cfm, wherein air permeability of the partially plugged foraminous belt is between about 150 cfm to about 700 cfm, wherein a ratio of the air permeability of the unplugged foraminous belt to the air permeability of the partially plugged foraminous belt is between about 1.2 and about 4, wherein the sealing compound is arranged only in and underneath the foraminous belt, and wherein the foraminous belt comprises a woven fabric comprising warp threads and weft threads delimiting the array of openings;

drawing air downward through unplugged openings in the foraminous belt to stabilize the filaments deposited on the foraminous belt;

pre-consolidating the nonwoven on the partially plugged foraminous belt; and directing air toward the nonwoven downstream of the deposition location.

* * * * *